United States Patent [19]

Cullinane

[11] Patent Number: 4,880,133

[45] Date of Patent: Nov. 14, 1989

[54] BUD VASE AND ATTACHMENT BRACKET

[76] Inventor: Dolores M. Cullinane, Box 75401, Northgate Sta., Seattle, Wash. 98125

[21] Appl. No.: 224,811

[22] Filed: Jul. 27, 1988

[51] Int. Cl.[4] ..... A01G 5/00

[52] U.S. Cl. ..... 220/85 H; 47/67; 47/41.15; 248/215; 248/229; 248/310; 248/313

[58] Field of Search ..... 220/85 H; 47/41 R, 41 SS, 47/41 G, 41.1, 41.12, 41.13, 67; 248/213.2, 214, 215, 229, 231.8, 310, 311.2, 313

[56] References Cited

U.S. PATENT DOCUMENTS

| | | | |
|---|---|---|---|
| 1,566,982 | 12/1925 | Shee | 47/67 X |
| 2,278,773 | 4/1942 | Erdmann | 47/41.12 |
| 2,765,585 | 10/1956 | Smithers | 47/41.12 |
| 3,027,014 | 3/1962 | Lindblom | 248/214 X |
| 3,113,677 | 12/1963 | Johnson | 248/214 X |
| 3,433,443 | 3/1969 | Mangan et al. | 248/214 |
| 4,247,070 | 1/1981 | Dirksing | 248/215 X |
| 4,418,496 | 12/1983 | Koistinen | 47/41.12 |
| 4,505,447 | 3/1985 | Shaheen | 248/313 X |
| 4,606,523 | 8/1986 | Statz et al. | 220/85 H X |
| 4,739,582 | 4/1988 | Cullinane | 47/41.12 |

*Primary Examiner*—John Rivell

*Attorney, Agent, or Firm*—Robert W. Jenny

[57] ABSTRACT

The bud vase has a bulbous lower portion and an elongated neck. The lower portion has a flat bottom. That and the elongated neck adapt it to be held by the bracket which comprises a clamp, a vase clip and a conversion clip. The clamp has a back portion which is a curved, springy strip that clips to the top of the back or end of structure such as a church pew. It has a front portion configured to provide a flat horizontal surface to support the vase by its flat bottom and to provide for attachment of a clip which holds the neck of the vase. The bracket is configured to hold the vase vertically when the bracket is used on structure such as pew backs slanted 15° off of vertical and, when fitted with the conversion clip, holds the vase vertical when the bracket is mounted on vertical structure such as the end of a pew. The bracket is a part molded in the form of a bent-to-shape strip of material.

2 Claims, 1 Drawing Sheet

BUD VASE AND ATTACHMENT BRACKET

BACKGROUND OF THE INVENTION

The subject invention is in the field of vases and the like for flowers and floral arrangements. More specifically, it is in the field of vases, flower holders and the like which, in combination with attachment, support or hanger apparatus, can be attached temporarily to a wall or piece of furniture such as a pew in a church. Further, it is in the field of such apparatus in which the holder and the attachment, support or hanger apparatus are separable and reusable individually.

PRIOR ART

The closest known prior art in this field comprises U.S. Pat. No. 4,418,496 Koistinen and U.S. Pat. No. 4,739,582 issued to the subject inventor. These two patents disclose apparatuses for holders for flowers and floral arrangements along with means for attaching the holders to structures such as the ends or backs of pews. However, it has been found that there is a need for holders for buds and single stem flowers attachable to structures such as pews and none of the known prior art makes provision for holding buds and single stem flowers, usually held in bud vases. Accordingly it is a prime objective of the subject invention to provide a bud vase adapted to be supported from structure such as a pew back or end by attachment apparatus. A further objective is that the bud vase be useful as a separate entity with its usefulness and ornamental quality not impaired by its adaptability to being held by the attachment apparatus. Another objective is that the attachment means be providable at a cost allowing more general use of the bud vases and attachment means. A further objective is that the attachment means enable holding the vase essentially vertical on slanted structure, such as pew backs and vertical structure such as pew ends. Another objective is that the attachment means be adaptable to attachment to structure in a range of thicknesses and further that the attachment will be structurally stable.

SUMMARY OF THE INVENTION

The invention comprises a bud vase adapted to be held by a bracket and the bracket for attaching the vase to the tops of ends or backs of pews and the like. The vase has a bulbous shaped lower portion with a flat bottom and a neck portion extending upward from the lower portion. The flat bottom enables use of the vase as a separate entity. The neck portion is cylindrical over at least part of its length to adapt it to being held by the bracket.

The bracket is an assembly comprising a clamp, a vase clip and, on occasion as described below, a conversion clip.

The clamp is molded in the form of a strip of plastic 0.10 thick and 1 inch wide. Its shape in side elevation is described with reference to the crossectional shape of a pew back to which the clamp is attached. The pew back has a flat front surface and a radiused top edge which fairs directly into the front surface and curves 230 degrees to intersect the back surface which is parallel to the front surface. For purposes of this description the seat back is vertical.

The front portion of the clamp extends from the point at which the clamp contacts the top of the back perpendicular to the plane of the front surface a distance beyond the front surface. It then bends downward 90°

(parallel to the front surface) the bend being radiused, and forms a first portion parallel to the front. It then bends 45° toward the front surface to contact the front surface. It then bends away from the surface at a 15° angle to the surface in a downward direction to a double bend which connects it to a second flat portion which is coplanar with the first portion. This second flat portion extends to again contact the front surface and then curve away from the surface to form a third flat portion perpendicular to the front surface. The bottom of the vase rests on this portion. The clamp then curves upward 90° to form a fourth flat portion and the lower portion of the vase fits snugly between the second and fourth flat portions. There is a double bend at the end of the fourth flat portion to form a detent which engages the lower portion to hold it against the third flat surface, i.e. the bottom of the clamp.

The back portion of the clamp extends from the point at which the clamp contacts the top of the back and curves down, around and away from the radiused portion and then, just before it contacts the rear surface, it curves in the direction away from the surface with its end clear of the surface.

The vase clip engages the edges of the first flat portion and extends perpendicular to it to engage the neck of the vase between two partial cylindrical surfaces.

The conversion clip engages the clamp portion which extends downward and away from the front surface at the 15° angle. It is wedge shaped to support that portion of the clamp away from the front surface.

When the clamp is attached to a pew back which is 15° off of vertical, the conversion clip is not needed because the portion to which it attaches contacts the front surface directly.

The back portion of the clamp flexes to accommodate various thicknesses of seat backs and the like. It is conformed to flex a specific amount when used on the thinnest structure on which its use in intended so that there is always at least a minimum clamping action on the seat back between the front and back portions of the clamp when the clamp is installed on a seat back or the like.

The invention is described in more detail below with reference to the attached drawings.

DETAILED DESCRIPTION OF THE INVENTION

Figure 1:
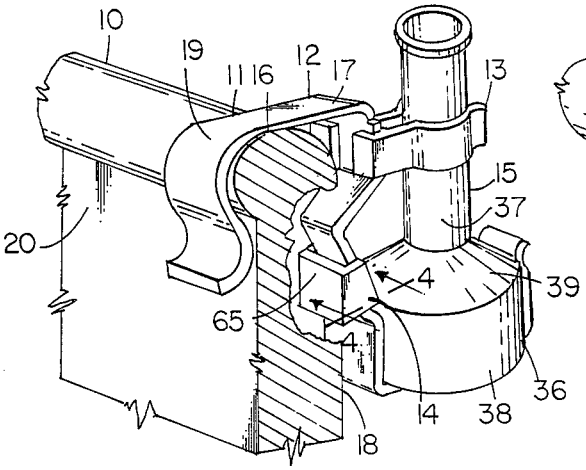
FIG. 1 is a sectional perspective view of the invention attached to vertical structure.
Figure 1A:
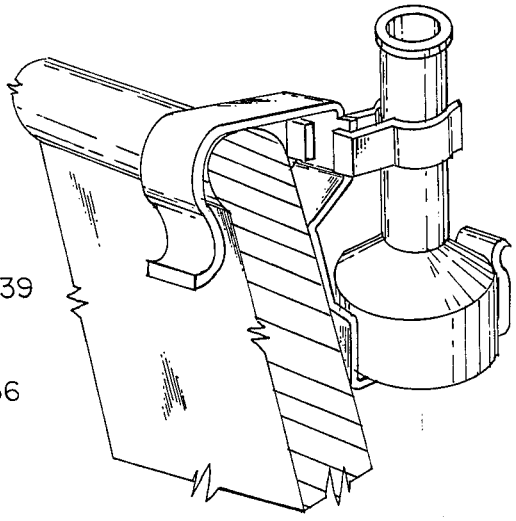
FIG. 1A illustrates the invention attached to the structure such as a seat back slanted 15° off vertical.

The invention is a specially adapted bud vase and a bracket for attaching it to structure such as the tops of the backs or ends of church pews and the like. It is shown in FIG. 1 attached to structure 10. The bracket 11 is an assembly comprising clamp 12, vase clip 13 and conversion clip 14, holding vase 15. The conversion clip is used when the bracket is attached to vertical structure as illustrated. When the invention is attached to structure such as a seat back slanted from vertical, as illustrated in FIG. 1A, the conversion clip is not needed. Clamp 12 contacts the top 16 of structure 10 and comprises a front portion 17 which extends over structure front surface 18 and a rear portion 19 which extends over the structure rear surface 20.

Figure 2:
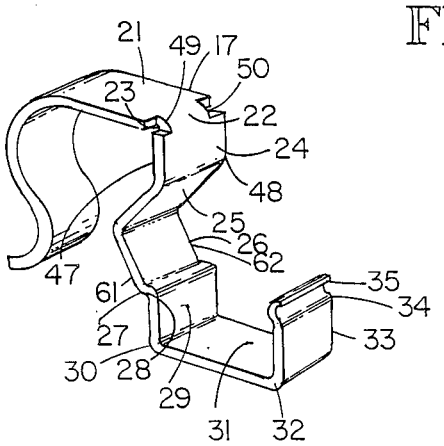
FIG. 2 is a perspective view of the clamp.

Referring to FIG. 2, illustrating the clamp in more detail, the front portion 17 comprises top 21, 90° bend 22 with radius 23, a first flat portion 24, portion 25 at a 135° angle to portion 26 at a 15° angle to the plane of portion 24, bend 27 followed by bend 28 leading to a second flat portion 29 coplanar with portion 24, bend 30, third flat portion 31, bend 32, fourth flat portion 33 and bends 34 and 35. Bends 34 and 35 form a detent which engages the vase as shown in FIG. 1 to hold it in place. As shown in FIG. 1, the vase comprises a bulbous lower portion 36 and a neck portion 37 extending upward from the lower portion. The lower portion has a flat bottom 38 so that it can stand alone and be used as a separate entity if desired. Bottom 38 contacts portion 31 of the clamp (FIG. 2) and the detent formed by bends 34 and 35 contacts sloping surface 39 of the lower portion of the vase.

Figure 3:
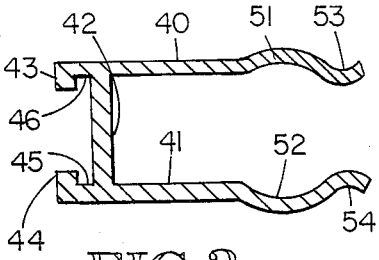
FIG. 3 is a view of the vase clip as seen from above in FIG. 1.

Vase clip 13, shown in FIG. 3 as seen from above in FIG. 1, comprises sides 40 and 41 joined by beam 42. Lips 43 and 44 on the sides form, in conjunction with the beam, notches 45 and 46 which engage edges 47 and 48 of portion 24 in FIG. 2 to hold the clip to the clamp. Such engagement is enabled by notches 49 and 50 in the clamp. Arced portions 51 and 52 of the vase clip engage the neck portion of the vase. Bends 53 and 54 each the entry of the neck into the clip.

Figure 4:
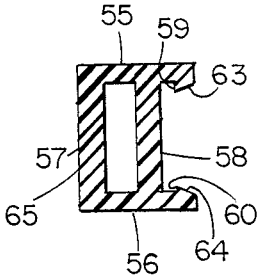
FIG. 4 is a sectional view of the conversion clip taken at 4—4 in FIG. 1.

Conversion clip 14, shown in a sectional view in FIG. 4, taken at 4—4 in FIG. 1, comprises sides 55 and 56 interconnected by beams 57 and 58. Lips 59 and 60 engage edges 61 and 62 of portion 26. Sloped surfaces 63 and 64 serve as cams to spread sides 55 and 56 apart to enable the lips to engage the clamp when the clip is pressed against the clamp. The conversion clip is sized and shaped such that when it is against bend 27, surface 65 is in the plane of the front surface 18 of the structure so that the bracket is stabilized to hold the vase in a vertical position. Structures such as the backs of pews are commonly constructed with the back 15° off of vertical. When the invention is attached to the top of such a structure the conversion clip is not needed. Portion 26 contacts the front surface of the structure directly to stabilize the bracket to hold the vase in a vertical position.

The bracket could be made with clamp and vase clip one piece. Further, it could be made in two versions, one for vertical structure and the other for slanted structure. However, it has been determined that the overall costs of providing the invention are less with a separable vase clip and with the use of the conversion clip to avoid the need for providing two versions. Further, the bracket without the vase clip is usable for holding other flower holders than bud vases.

It is considered that it is clear from this description that the invention meets its objectives. It provides a bud vase adapted to be supported from a structure such as a pew back or end by attachment apparatus. The vase is usable as a separate entity with its usefulness and ornamental quality not impaired by its adaptability to being held by attachment apparatus. The concept allows providing the invention at costs which allow more general use of the invention. Further, it is usable on vertical support structure such as pew ends and slanted structure such as pew backs with the vase held vertically in each case. Also, it is attachable to structures in a range of thicknesses and is structurally stable in all instances.

It is further considered understandable that while a preferred embodiment of the invention is described herein, other embodiments and modifications of the one described are possible within the scope of the invention which is limited only by the attached claims.

What is claimed is:

1. A vase having a bulbous lower portion and a neck portion, said lower portion having a planar bottom, said vase being adapted to be held by a bracket, said bracket being attachable to structure having a top edge and a front surface oriented essentially 15° off of vertical, said bracket being attachable to said top edge and comprising:

a clamp and a vase clip said clamp having a surface for supporting said vase by contact with said bottom and being configured so that with said bracket attached to said structure said surface for supporting is horizontal, said clamp further having detent means for contacting said lower portion and holding said bottom in contact with said surface for supporting, said vase clip being detachably attachable to said clamp and said neck portion, whereby when said bracket is attached to said top edge, said bottom is on said surface for supporting, said detent means is holding said bottom on said surface for supporting and said neck is attached to said clamp by said vase clip, said vase is attached to said structure and oriented vertically.

2. A vase having a bulbous lower portion and a neck portion, said lower portion having a planar bottom, said vase being adapted to be held by a bracket, said bracket being attachable to structure having a top edge and a front surface oriented essentially vertical, said bracket being attachable to said top edge and comprising:

a clamp and a vase clip said clamp having a surface for supporting said vase by contact with said bottom, said clamp further having detent means for contacting said lower portion and holding said bottom in contact with said surface for supporting, said vase clip being detachably attachable to said clamp and said neck portion, a conversion clip attachable to said clamp, whereby when said bracket is attached to said top edge, said bottom is on said surface for supporting, said detent means is holding said bottom on said surface for supporting and said neck is attached to said clamp by said vase clip, said conversion clip maintaining said surface for supporting horizontal, and said vase is attached to said structure and oriented vertically.

* * * * *